US007828592B2

(12) United States Patent
Tobey et al.

(10) Patent No.: US 7,828,592 B2
(45) Date of Patent: Nov. 9, 2010

(54) INTERFACE MODULE

(75) Inventors: Shawn Phillip Tobey, Trinity, NC (US); Paul John Pepe, Clemmons, NC (US); Sheldon Easton Muir, Whitsett, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/048,859

(22) Filed: Mar. 14, 2008

(65) Prior Publication Data

US 2009/0233469 A1 Sep. 17, 2009

(51) Int. Cl.
*H01R 13/73* (2006.01)

(52) U.S. Cl. ..... 439/564; 439/939

(58) Field of Classification Search ..... 439/97, 439/564, 607, 939
See application file for complete search history.

(56) References Cited

U.S. PATENT DOCUMENTS 4,895,535 A * 1/1990 Emadi et al. ..... 439/681
5,403,099 A * 4/1995 Stein ..... 384/437
5,709,569 A * 1/1998 Buck et al. ..... 439/607
6,149,444 A * 11/2000 Shi et al. ..... 439/95
6,364,706 B1 * 4/2002 Ando et al. ..... 439/607
6,552,905 B2 * 4/2003 Herring et al. ..... 361/704
6,608,764 B2 * 8/2003 Clark et al. ..... 361/796
6,697,217 B1 * 2/2004 Codilian ..... 360/97.01
7,326,063 B1 * 2/2008 Raudenbush et al. ..... 439/63
7,357,645 B2 * 4/2008 Jeong et al. ..... 439/66
2008/0002937 A1 1/2008 Spisany et al.

FOREIGN PATENT DOCUMENTS

EP 0 929 199 A 7/1999

OTHER PUBLICATIONS

Partial International Search Report, International Application No. PCT/US2009/001631, International Filing Date Mar. 13, 2009.

* cited by examiner

*Primary Examiner*—Thanh-Tam T Le

(57) ABSTRACT

An interface module includes a housing configured to hold at least one modular jack. The housing is configured to be mounted on a panel. The housing includes an electrically conductive portion. An electrically conductive fastener has a housing interface configured to engage the electrically conductive portion of the housing and a panel interface configured to engage an electrically conductive surface of the panel. The electrically conductive fastener creates an electrical connection between the housing and the panel.

13 Claims, 11 Drawing Sheets

INTERFACE MODULE

BACKGROUND OF THE INVENTION

This invention relates generally to connector modules that interface network components and, more particularly to an interface module for shielded connectors.

Electronic components are typically connected to an electronic network using patch panels that allow connections between components in the network. In some applications, an interface module may be retained in the patch panel. The interface module contains a plurality of modular jacks and provides a removable method for mounting the plurality of jacks into a single opening in the patch panel or other network structure. In a typical application, the interface module is mounted on the patch panel and one or more network components, such as, but not limited to, a cable assembly is then coupled to the interface module.

Conventional interface modules are configured to receive an unshielded cable assembly and do not form a continuous bond and/or grounding path between the network component (s) and the patch panel. However, to meet the current performance requirements of many applications, the modular jacks must be shielded, for example, by enclosing the modular jacks in a metal housing. It is preferable that all components be shielded and all shields be sufficiently bonded. However, conventional interface modules do not enable shielded jacks to be bonded sufficiently and/or grounded to the patch panel.

Accordingly, a need remains for an interface module that enables a more effective method to complete a bonded and/or grounded path between one or more network components (such as, but no limited to, a cable assembly and/or the like) and a patch panel.

BRIEF DESCRIPTION OF THE INVENTION

In one embodiment, an interface module is provided including a housing configured to hold at least one modular jack. The housing is configured to be mounted on a panel. The housing includes an electrically conductive portion. An electrically conductive fastener has a housing interface configured to engage the electrically conductive portion of the housing and a panel interface configured to engage an electrically conductive surface of the panel. The electrically conductive fastener creates an electrical connection between the housing and the panel.

Optionally, the electrically conductive fastener includes a threaded portion that is configured to engage a threaded portion of the panel. The threaded portion of the panel may optionally include a nut. Optionally, the electrically conductive fastener includes a rivet. The electrically conductive fastener may optionally include a quarter-turn or a half-turn fastener that may optionally be configured to be received within a spring-loaded receptacle of the panel.

In another embodiment, an interface module is provided that includes a plurality of modular jacks and a housing holding the plurality of modular jacks. The housing is configured to be mounted on a panel such that the plurality of modular jacks are mounted on the panel. The housing includes an electrically conductive portion. An electrically conductive fastener has a housing interface configured to engage the electrically conductive portion of the housing and a panel interface configured to engage an electrically conductive surface of the panel. The electrically conductive fastener creates an electrical connection between the housing and the panel.

DETAILED DESCRIPTION OF THE INVENTION

Figure 1:
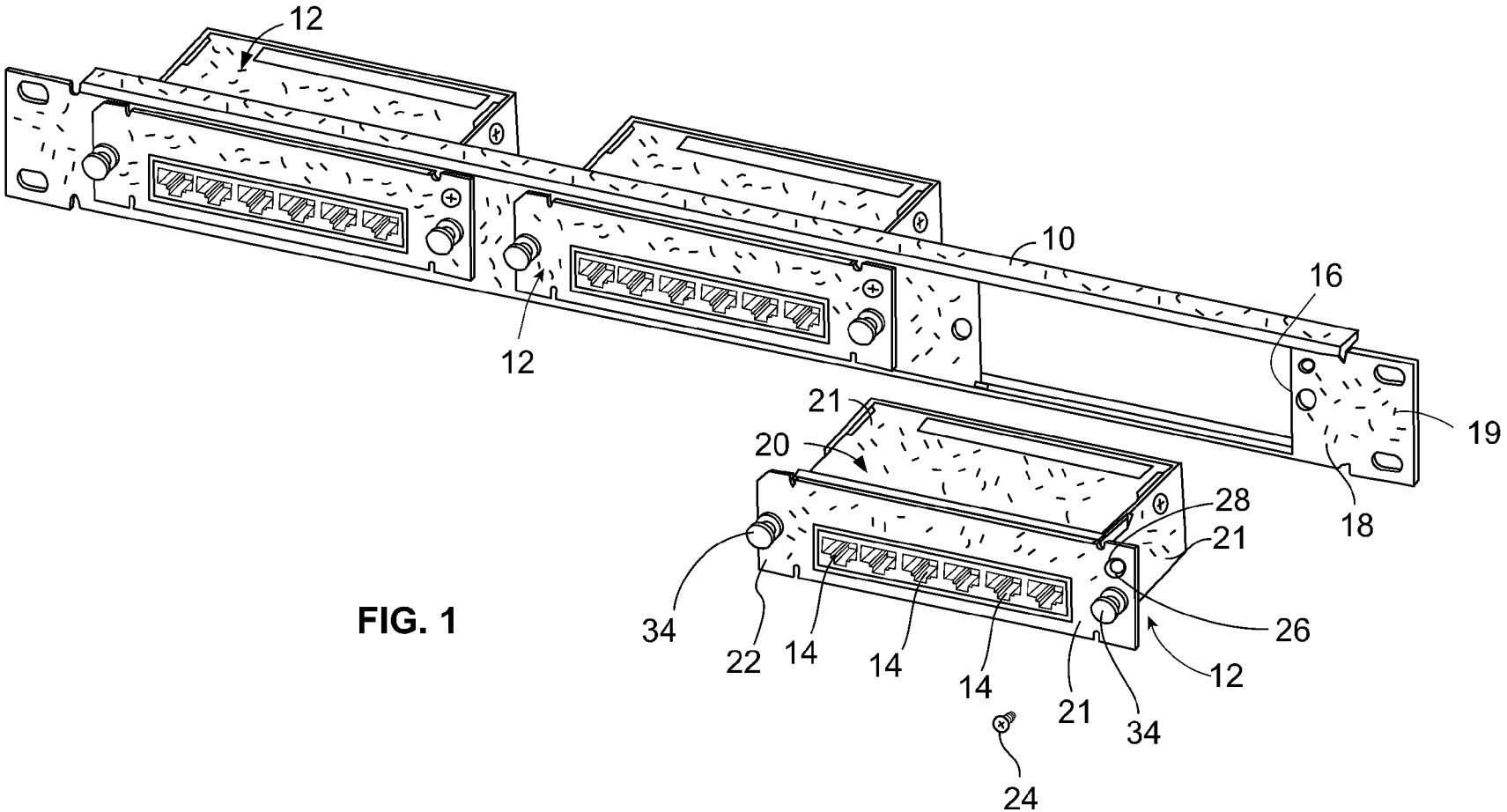
FIG. 1 is a partially exploded perspective view of an exemplary embodiment of a panel and an exemplary embodiment of a plurality of interface modules mounted on the panel.

FIG. 1 is a partially exploded perspective view of an exemplary embodiment of a panel 10 and an exemplary embodiment of a plurality of interface modules 12 mounted on the panel 10. Each interface module 12 includes a plurality of modular jacks 14. As described herein, the interface modules 12 are each adapted for use with shielded modular jacks 14. In the exemplary embodiments, each interface module 12 simultaneously mounts a plurality of shielded modular jacks 14 to the panel 10. Each of the shielded modular jacks 14 is configured to receive a pluggable electrical component (not shown) and each interface module 12 is electrically connected to a network component (not shown), such as, but not limited to, a cable assembly and/or the like. Accordingly each of the interface modules 12 enables one or more pluggable electrical components to be electrically connected to one or more network components.

As will be described in more detail below, each interface module 12 provides an electrical connection between the shielded modular jacks 14 and the panel 10. Each interface module 12 thereby provides an electrical connection between the network component(s) and the panel 10. Optionally when one of the components (e.g. the panel 10) is coupled to ground (e.g. electrically grounded), then the electrical connection between the shielded modular jacks 14 and the panel 10 defines a ground path between the shielded modular jacks 14 and the panel 10. Accordingly when one of the components (e.g. the panel 10) is coupled to ground (e.g. electrically grounded), then the electrical connection between the shielded modular jacks 14 and the panel 10 defines a ground path between the network component(s) and the panel 10.

In some embodiments, the shielded modular jacks 14 are at least partially metalized, such as by an injection process, providing the modular jacks 14 with a metal housing, or by mounting a shield component to the modular jacks 14. The shielded modular jacks 14 may each be any type of shielded cable connector, such as, but not limited to, the shielded modular RJ-45 jack illustrated in the Figures. In an exemplary electronic network in which the shielded modular jacks 14 are utilized, the metalized portion of each of the shielded modular jacks 14 is electrically connected to a grounded component, such as the panel 10, to provide a ground path to the modular jacks 14. When the interface modules 12 are mounted on the panel 10, each interface module 12 provides a ground path to ground the corresponding shielded modular jacks 14 to the panel 10.

In the exemplary embodiment, each interface module 12 holds a plurality of modular jacks 14 that are formed as an integral unit, which is sometimes referred to as a "cassette" or a "multi-port jack". In addition or alternative, each interface module 12 may hold one or more single modular jacks 14, which are sometimes referred to as "single-port jacks". Although the interface modules 12 are each shown as holding one multi-port jack having six modular jacks 14, each interface module 12 may hold any number of multi-port jacks each having any number of modular jacks 14. Moreover, each interface module 12 may hold any number of modular jacks 14 overall, whether the modular jacks 14 are comprised of one or more multi-port jacks, one or more single-port jacks, and/or a combination of one or more multi-port jacks and one or more single-port jacks.

As illustrated in FIG. 1, each interface module 12 is mounted within a corresponding opening 16 of the panel 10. The panel 10 includes a plurality of openings 16 for holding the plurality of interface modules 12. Alternatively, the panel 10 holds only one interface module 12. Optionally the openings 16 may receive interface modules 12 having either shielded modular jacks, as illustrated in FIG. 1, or non-shielded modular jacks. The panel 10 includes a planar front surface 18, and the interface modules 12 are mounted against the front surface 18. In the illustrated embodiment the panel 10 is a patch panel that may be mounted on a rack (not shown in FIG. 1). In alternative embodiments, the panel 10 may be another type of network component used within a network system that supports modular jacks, such as, but not limited to, a switch, a power box, and/or the like. The panel 10 is at least partially metallic and a means to ground the panel 10 is provided, such as a frame, rack, cable, wire, or other structure that is electrically connected to the panel 10. The metal of the panel 10 may optionally be at least partially coated with a non-electrically conductive material 19 such as, but not limited to, urethane powder coat, acrylic paint, and/or the like.

In an exemplary embodiment each interface module 12 includes a housing 20 that is at least partially metallic, such that at least a portion of the housing 20 is electrically conductive. The metal of the housing 20 may optionally be at least partially coated with a non-electrically conductive material 21 such as, but not limited to, urethane powder coat, acrylic paint, and/or the like. The housing 20 includes a face plate 22 that engages the front surface 18 of panel 10 when the interface modules 12 are mounted on the panel 10.

When the shielded modular jacks 14 are assembled into the housing 20, a printed circuit board (not shown) that is attached to the shielded modular jacks 14 electrically connects to an electrically conductive portion of the housing 20 to create an electrical connection between the shielded modular jacks 14 and the corresponding housing 20. However, when both the housing 20 and the panel 10 are coated with a non-electrically conductive material, engagement between the housing face plate 22 and the panel front surface 18, as well as engagement between other areas of the housing 20 and the panel 10, will not provide an electrical connection between the housing 20 and the panel 10 because the portions of the housing 20 and the panel 10 that engage are covered by the non-electrically conductive coatings 21 and 19, respectively. An electrically conductive fastener 24 is therefore provided to facilitate mounting each interface module 12 to the panel 10. Specifically the electrically conductive fastener 24 engages an electrically conductive portion 26 of the housing 20 that is exposed via an opening 28 within the non-electrically conductive coating 21 of the housing 20. Similarly the electrically conductive fastener 24 engages an electrically conductive surface 30 (FIGS. 2 and 3) of the panel 10 that is exposed relative to the non-electrically conductive coating 19 of the panel 10. The electrically conductive fastener 24 thereby electrically connects the housing 20 to the panel 10. Accordingly when the shielded modular jacks 14 are assembled into the interface modules 12, and the interface modules 12 are held by the panel 10, an electrical connection is made between the shielded modular jacks 14 and the panel 10. Optionally when one of the components (e.g. the panel 10) is coupled to ground (e.g. electrically grounded), then the electrical connection defines a ground path between the shielded modular jacks 14 and the panel 10. The electrically conductive fastener 24 may also facilitate mechanically coupling the housing 20 to the panel 10.

The electrically conductive fasteners described and illustrated herein may be any suitable type of fastener, and may have any suitable shapes, sizes, and configurations that enable the electrically conductive fastener to electrically connect the interface module housings described and illustrated herein to the panels described and illustrated herein. Non-limiting examples of suitable electrically conductive fasteners are described in more detail below. Although each exemplary interface module described below includes one electrically conductive fastener, each interface module may include any number of electrically conductive fasteners.

In addition to the electrically conductive fasteners, each interface module described and illustrated herein may include one or more non-electrically conductive fasteners (e.g., the fastener 34) that facilitate mechanically coupling the interface module housings to the panel.

Figure 2:
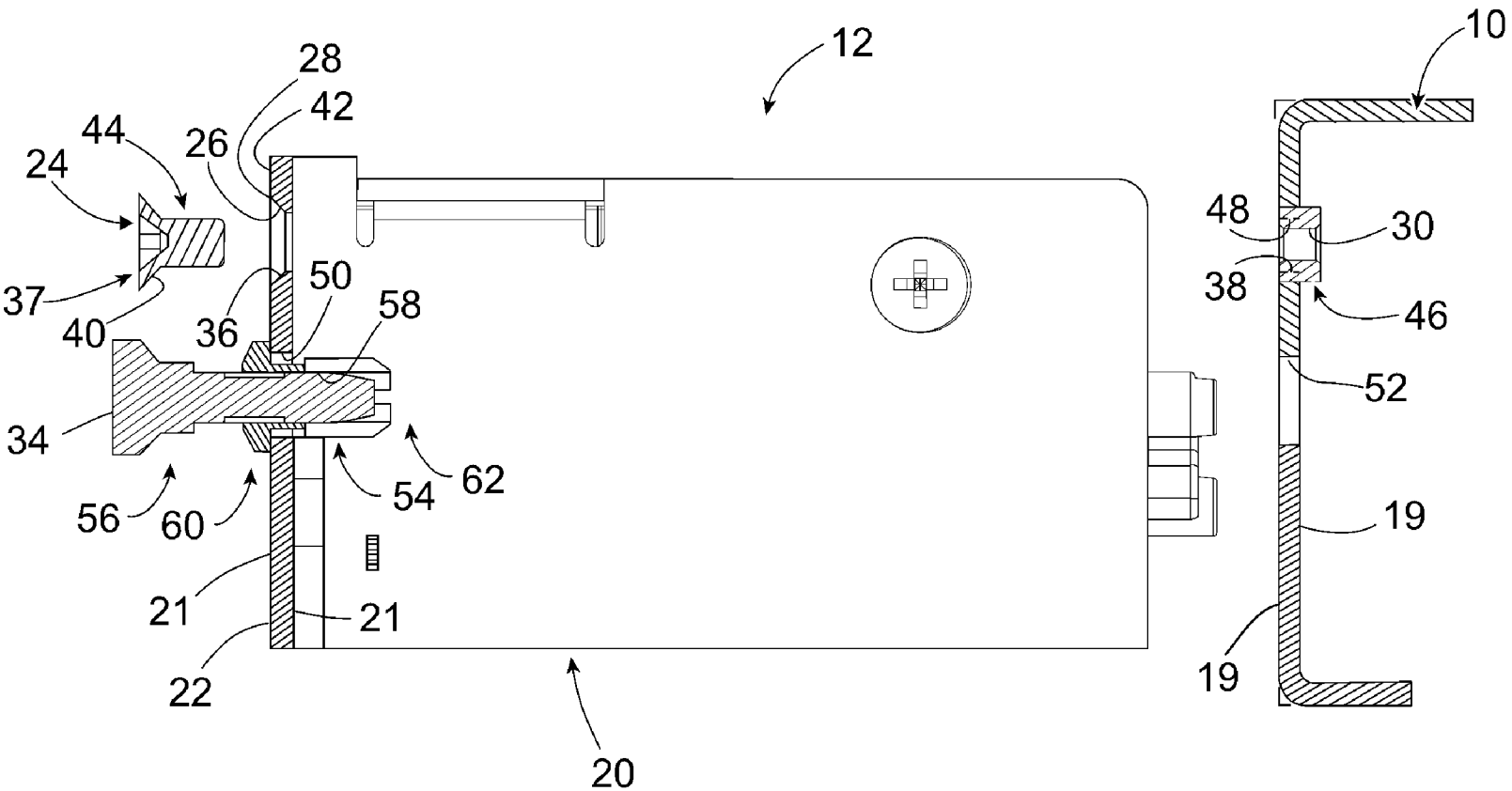
FIG. 2 is an exploded cross-sectional view of an interface module and the panel shown in FIG. 1.
Figure 3:
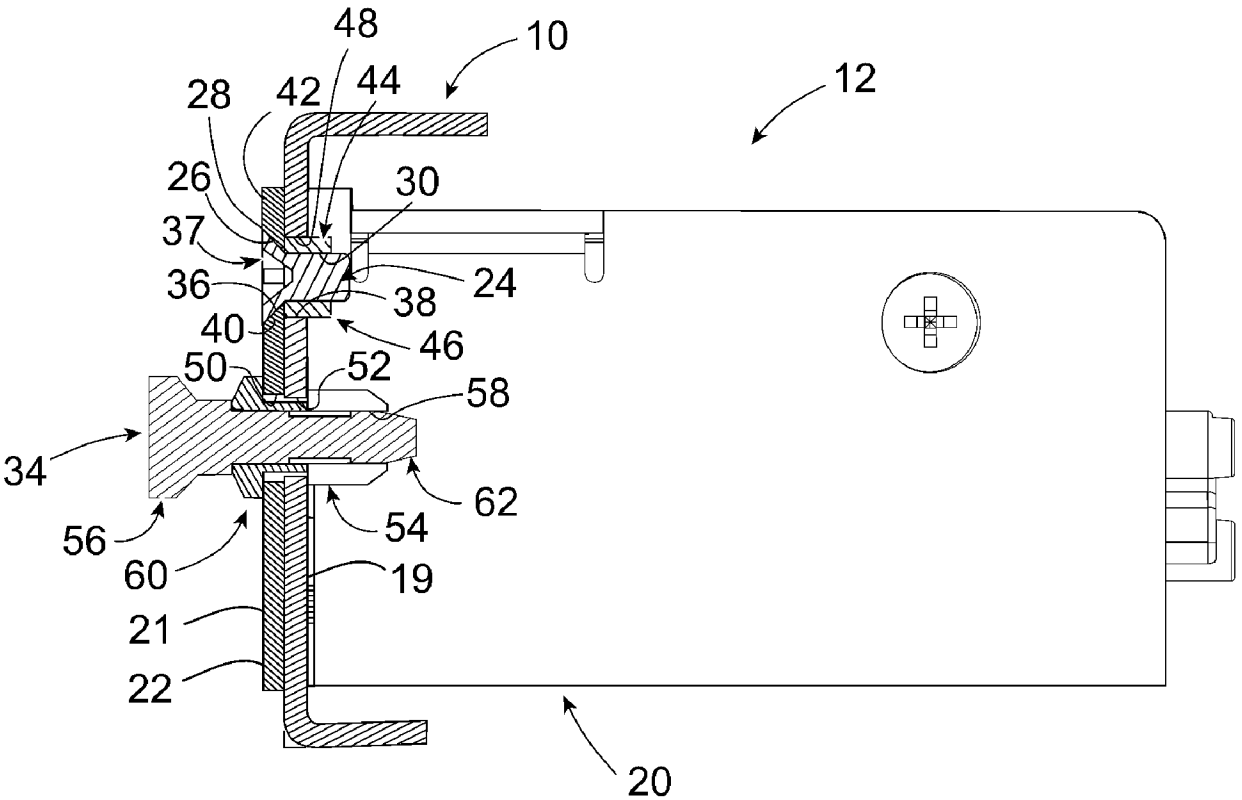
FIG. 3 is a cross-sectional view of the interface module and the panel shown in FIGS. 1 and 2 illustrating the interface module mounted on the panel.

FIG. 2 is an exploded cross-sectional view of an interface module 12 and the panel 10. FIG. 3 is a cross-sectional view of the interface module 12 and the panel 10 illustrating the interface module 12 mounted on the panel 10. Referring now to FIGS. 1-3, the face plate 22 of the housing 20 includes an opening 36 extending there through and the panel 10 includes an opening 38 extending there through. The openings 36 and 38 each receive the electrically conductive fastener 24 therein when the interface module 12 is mounted on the panel 10. In the exemplary embodiment of FIGS. 1-3, the electrically conductive fastener 24 includes a flat head 37 such that the electrically conductive fastener 24 is a recessed flat head screw. When the electrically conductive fastener 24 is received within the opening 36, a housing interface 40 of the electrically conductive fastener 24 engages the electrically conductive portion 26 of the housing 20 that is exposed via the opening 28 within the non-electrically conductive coating 21. In the exemplary embodiment of FIGS. 1-3, the electrically conductive portion 26 of the housing 20 defines a portion of the opening 36 and is a recessed surface to accommodate the head 37 of the electrically conductive fastener 24. Accordingly when the electrically conductive fastener 24 is fully received within the opening 36 such that the housing interface 40 is engaged with the electrically conductive portion 26 of the housing 20, the head 37 of the electrically conductive fastener 24 is flush with an outer surface 42 of the housing face plate 22.

The electrically conductive fastener 24 includes a panel interface 44 that engages the electrically conductive surface 30 of the panel 10. In the exemplary embodiment of FIGS. 1-3, the electrically conductive surface 30 is defined by a nut 46 that defines a threaded portion of the panel 10. The panel interface 44 of the electrically conductive fastener 24 defines a threaded portion of the electrically conductive fastener 24 that engages the threaded portion of the panel 10. Although in the exemplary embodiment the nut 46 is held within the opening 38 of the panel 10 even when not threadably engaged with the electrically conductive fastener 24, alternatively the nut 46 may only be attached to the panel 10 when the nut 46 is threadably engaged with the electrically conductive fastener 24. Moreover, the nut 46 may optionally not be included and instead a surface 48 of the panel 10 defining the opening 38 may include a threaded portion for engagement with the electrically conductive fastener 24. In the exemplary embodiment of FIGS. 1-3, the surface 48 defining the opening 38 and the nut 46 are not coated with the non-electrically conductive coating 19 of the panel 10 such that the nut 46 is electrically connected to the panel 10 via the surface 48. Moreover, the threaded portion of the nut 46 is not coated with the non-electrically conductive coating 19 of the panel.

When the interface module 12 is mounted on the panel 10 the electrically conductive fastener 24 is threadably engaged with the nut 46 such that the housing interface 40 is engaged with the electrically conductive portion 26 of the housing and the panel interface 44 is engaged with the electrically conductive surface 30 of the nut 46. Accordingly the housing 20 is electrically connected to the panel 10 via the electrically conductive fastener 24.

The nut 46 may be any suitable type of nut that enables the nut 46 to function as described herein. In the exemplary embodiment the nut 46 is a self-clinching PEM® nut.

Figure 10:
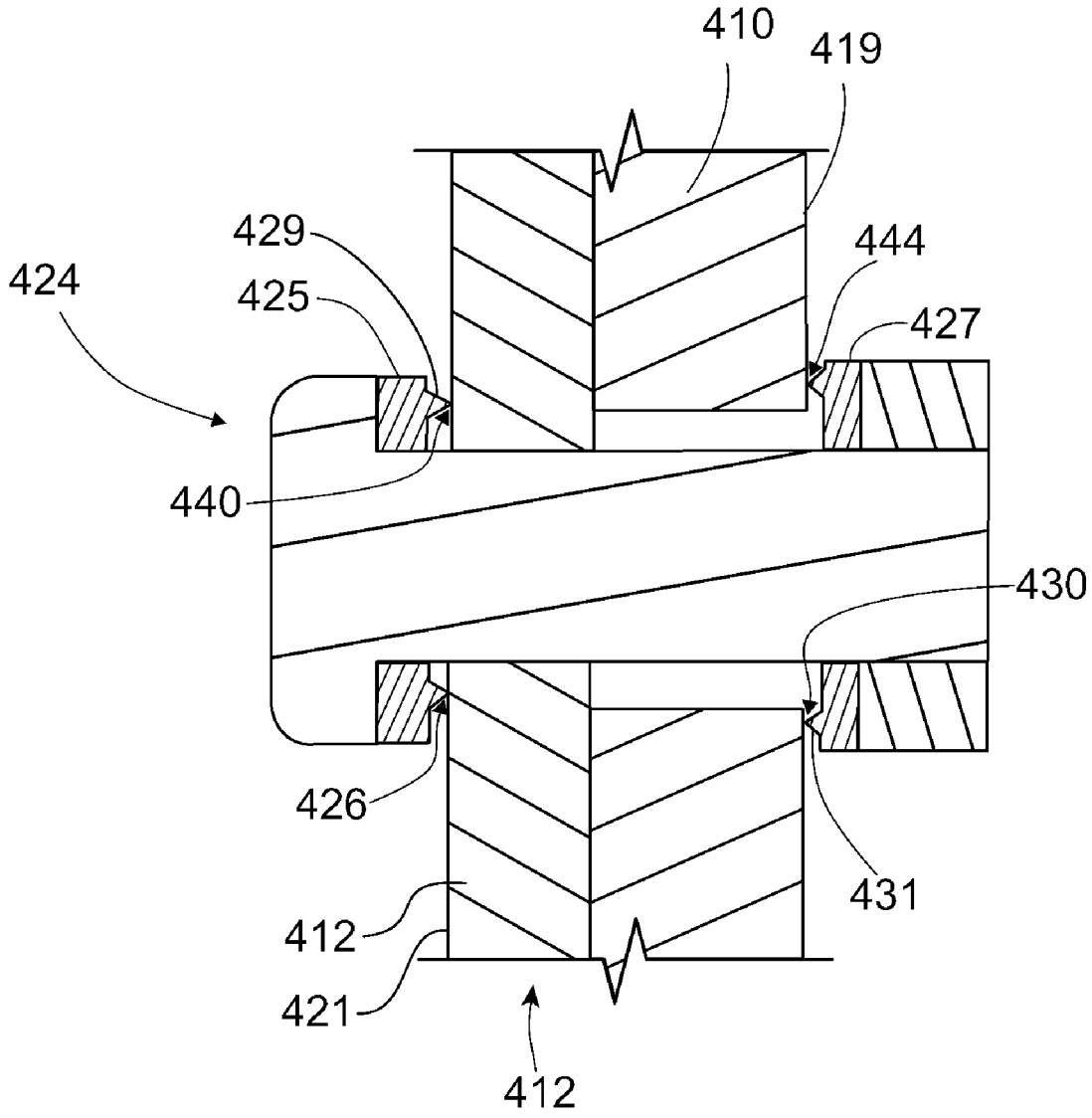
FIG. 10 is a cross sectional view of a portion of an exemplary embodiment of a panel and an alternative exemplary embodiment of an interface module mounted on the panel.

In an alternative embodiment the electrically conductive portion 26 and/or the electrically conductive surface 30 are not initially exposed from the non-electrically conductive coatings 21 and 19, respectively, and the electrically conductive fastener 24 includes a component (such as, but not limited to, one or more extensions, one or more washers each having one or more extensions, and/or the like) that pierces through the non-electrically conductive coating 19 of the panel 10 and/or the non-electrically conductive coating 21 of the interface module 12. For example, FIG. 10 illustrates an electrically conductive fastener 424 having a pair of washers 425 and 427 that each include a plurality of respective extensions 429 and 431 that pierce through a non-electrically conductive coating 419 of a panel 410 and a non-electrically conductive coating 421 of an interface module 412, respectively. By piercing the non-electrically conductive coating 421, the extensions 429 define a housing interface 440 that engages an electrically conductive portion 426 of a housing 420 of the interface module 412. Similarly by piercing the non-electrically conductive coating 419, the extensions 431 define a panel interface 444 that engages an electrically conductive surface 430 of the panel 410. The extensions 429 and 431 thereby electrically connect the electrically conductive fastener 424 to both the panel 410 and the interface module 412.

Referring again to FIGS. 1-3, the interface module 12 optionally includes one or more non-electrically conductive fasteners 34 that facilitate mechanically coupling the interface module 12 to the panel 10. The non-electrically conductive fasteners 34 may each be any suitable type of fastener, and may each have any suitable shapes, sizes, and configurations that enable the non-electrically conductive fastener 34 to facilitate mechanically coupling the interface module 12 to the panel 10. In the exemplary embodiment of FIGS. 1-3, the non-electrically conductive fastener 34 is a separable rivet that extends through a pair of respective openings 50 and 52 within the housing 20 and the panel 10. The non-electrically conductive fastener 34 includes a grommet 54 and a plunger 56 received within an opening 58 within the grommet 54. The grommet 54 extends between an end portion 60 that engages the housing 20 and an opposite end portion 62 that engages the panel 10. The plunger 56 is movable within the grommet opening 58 between an unlatched position (FIG. 2) and a latched position (FIG. 3). In the latched position, the grommet 54 is radially expanded such that the grommet 54 engages the panel 10 to facilitate coupling the housing 20 and the panel 10 together. Although two non-electrically conductive fasteners 34 are shown in FIG. 1, the interface module 12 may include any number of non-electrically conductive fasteners 34.

Figure 4:
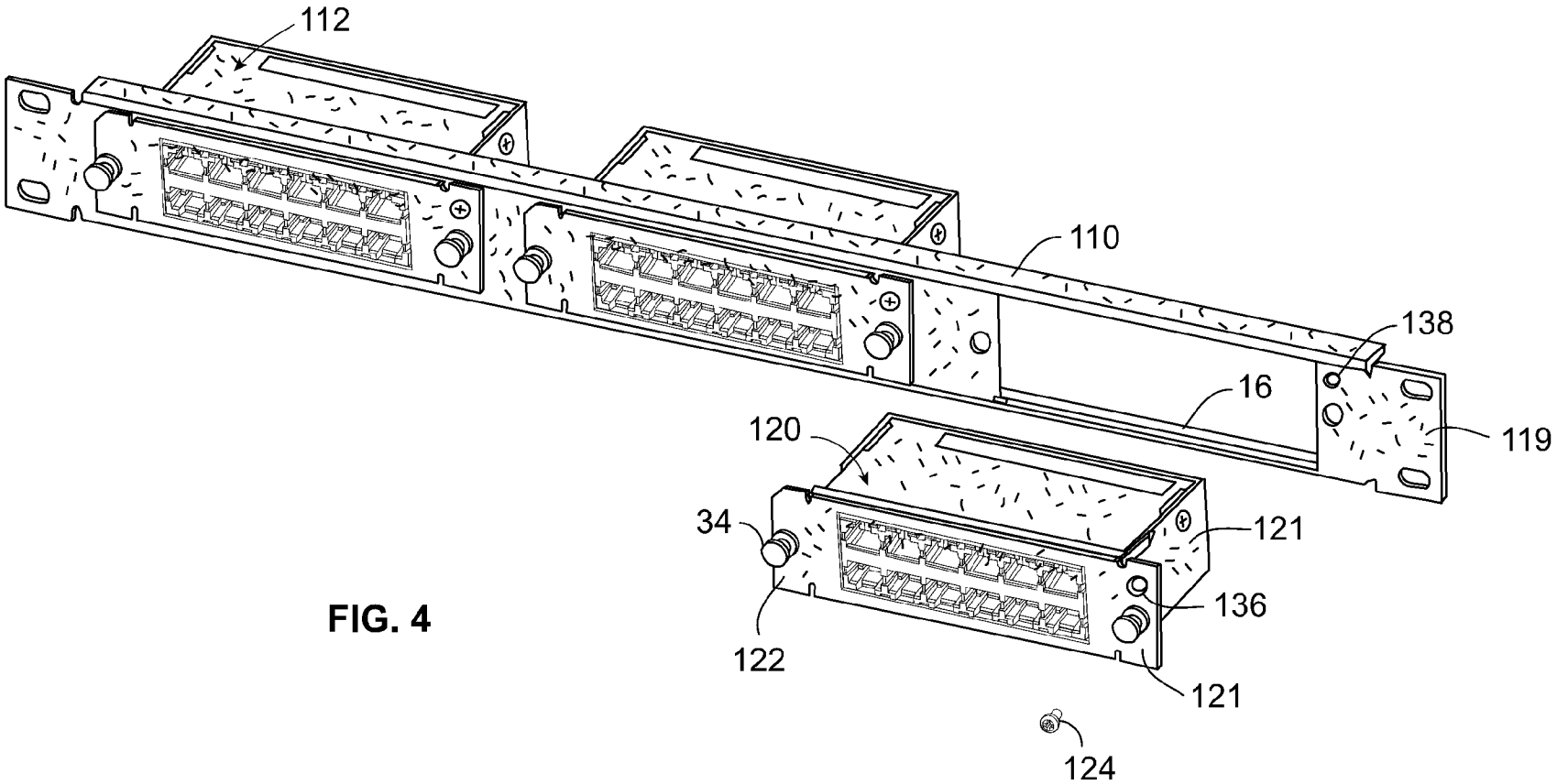
FIG. 4 is a partially exploded perspective view of an alternative exemplary embodiment of a panel and an alternative exemplary embodiment of a plurality of interface modules mounted on the panel.
Figure 5:
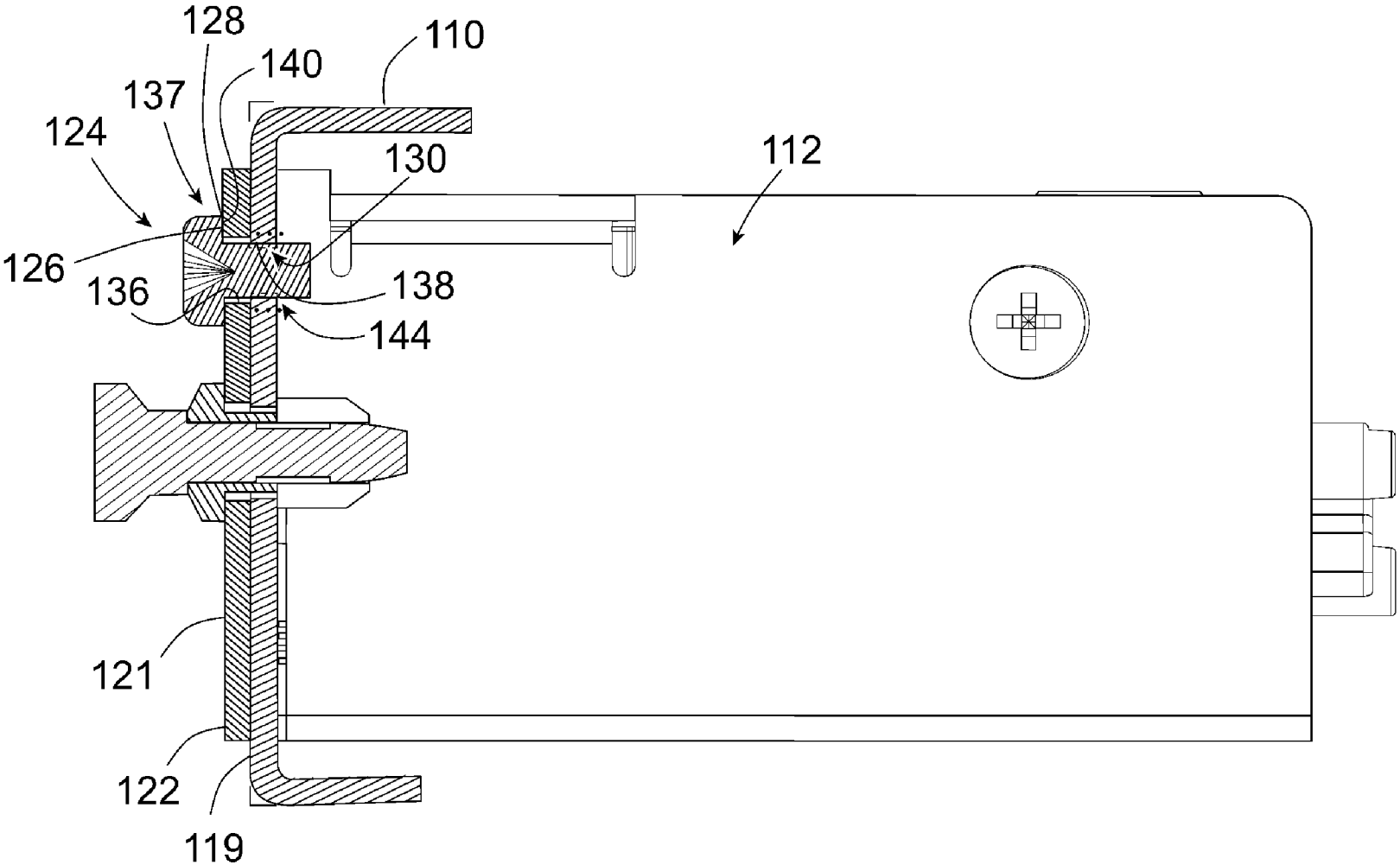
FIG. 5 is a cross-sectional view of an interface module and the panel shown in FIG. 4 illustrating the interface module mounted on the panel.

FIG. 4 is a partially exploded perspective view of an alternative exemplary embodiment of a panel 110 and an alternative exemplary embodiment of a plurality of interface modules 112 mounted on the panel 110. FIG. 5 is a cross-sectional view of an interface module 112 and the panel 110 illustrating the interface module 112 mounted on the panel 110. A face plate 122 of a housing 120 of the interface module 112 includes an opening 136 extending there through and the panel 110 includes an opening 138 extending there through. The openings 136 and 138 each receive an electrically conductive fastener 124 therein when the interface module 112 is mounted on the panel 110. In the exemplary embodiment of FIGS. 4 and 5, the electrically conductive fastener 124 includes a pan head 137 such that the electrically conductive fastener 124 is a pan head screw. When the electrically conductive fastener 124 is received within the opening 136, a housing interface 140 of the electrically conductive fastener 124 engages an electrically conductive portion 126 of the housing 120 that is exposed via an opening 128 within a non-electrically conductive coating 121 of the housing 120.

The electrically conductive fastener 124 includes a panel interface 144 that engages an electrically conductive surface 130 of the panel 110. In the exemplary embodiment of FIGS. 4 and 5, the electrically conductive surface 130 defines the opening 138. The electrically conductive surface 130 defines a threaded portion of the panel 110 for engagement with the electrically conductive fastener 124. Alternatively, the electrically conductive surface 130 is defined by a nut (not shown) that defines a threaded portion of the panel 110. The panel interface 144 of the electrically conductive fastener 124 defines a threaded portion of the electrically conductive fastener 124 that engages the threaded portion of the panel 110. In the exemplary embodiment of FIGS. 4 and 5, the electrically conductive surface 130 defining the opening 138 is not coated with a non-electrically conductive coating 119 of the panel 110.

When the interface module 112 is mounted on the panel 110, the electrically conductive fastener 124 is threadably engaged with the panel 110 such that the housing interface 140 is engaged with the electrically conductive portion 126 of the housing and the panel interface 144 is engaged with the electrically conductive surface 130. Accordingly the housing 120 is electrically connected to the panel 110 via the electrically conductive fastener 124.

Figure 6:
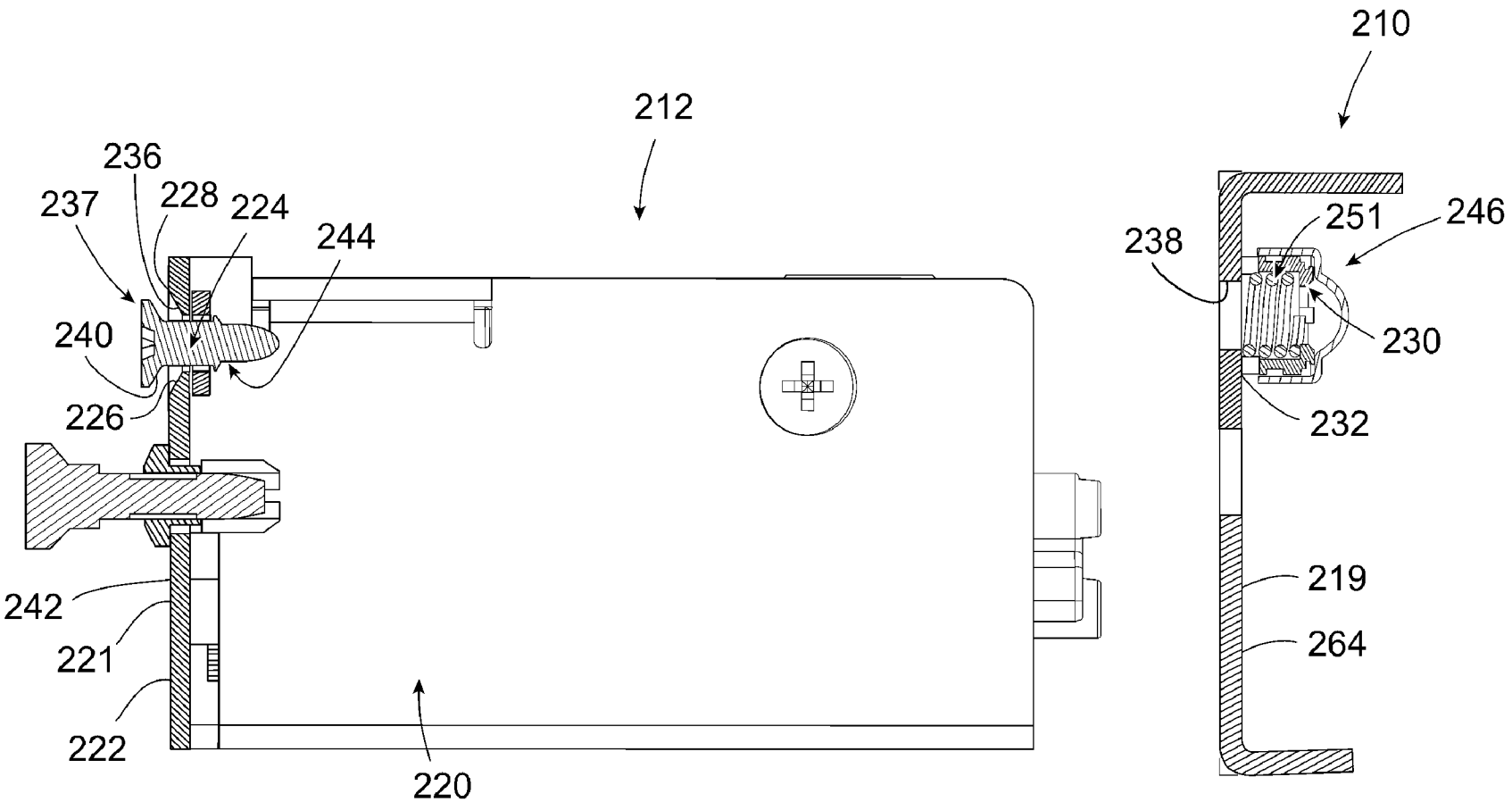
FIG. 6 is an exploded cross-sectional view of an alternative exemplary embodiment of a panel and an alternative exemplary embodiment of an interface module.
Figure 7:
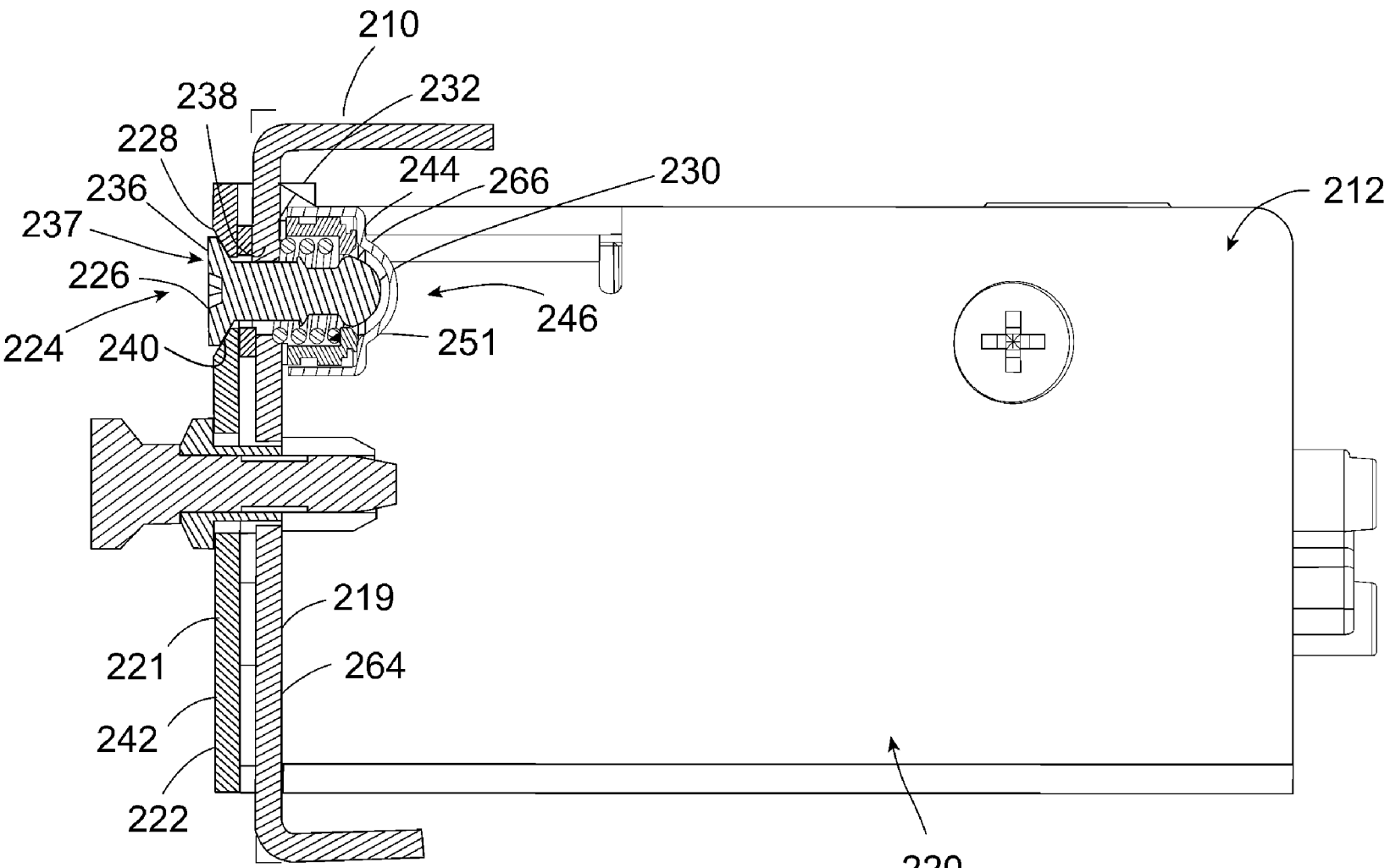
FIG. 7 is a cross sectional view of the interface module and the panel shown in FIG. 6 illustrating the interface module mounted on the panel.

FIG. 6 is an exploded cross-sectional view of an alternative exemplary embodiment of a panel 210 and an alternative exemplary embodiment of an interface module 212. FIG. 7 is a cross sectional view of the interface module 212 and the panel 210 illustrating the interface module 212 mounted on the panel 210. A face plate 222 of a housing 220 of the interface module 212 includes an opening 236 extending there through and the panel 210 includes an opening 238 extending there through. The openings 236 and 238 each receive an electrically conductive fastener 224 therein when the interface module 212 is mounted on the panel 210. When the electrically conductive fastener 224 is received within the opening 236, a housing interface 240 of the electrically conductive fastener 224 engages an electrically conductive portion 226 of the housing 220 that is exposed via an opening 228 within a non-electrically conductive coating 221 of the housing 220. In the exemplary embodiment of FIGS. 6 and 7, the electrically conductive portion 226 of the housing 220 defines a portion of the opening 236 and is a recessed surface to accommodate a head 237 of the electrically conductive fastener 224. Accordingly when the electrically conductive fastener 224 is fully received within the opening 236 such that the housing interface 240 is engaged with the electrically conductive portion 226 of the housing 220, the head 237 of the electrically conductive fastener 224 is flush with an outer surface 242 of the housing face plate 222.

The electrically conductive fastener 224 includes a panel interface 244 that engages an electrically conductive surface 230 of the panel 210. In the exemplary embodiment of FIGS. 6 and 7, the electrically conductive surface 230 is defined by a spring-loaded receptacle 246 of the panel 10. The spring-loaded receptacle 246 is electrically connected to an inner surface 264 of the panel 210 that is exposed via an opening 232 within a non-electrically conductive coating 219 of the panel 210.

When the interface module 212 is mounted on the panel 210, a stud 266 of the panel interface 244 of the electrically conductive fastener 224 is engaged with the electrically conductive surface 230 of the spring-loaded receptacle 246 such that the housing interface 240 is engaged with the electrically conductive portion 226 of the housing 220 and the panel interface 244 is engaged with the electrically conductive surface 230. Accordingly the housing 220 is electrically connected to the panel 210 via the electrically conductive fastener 224. A spring 251 of the spring-loaded receptacle 246 biases the electrically conductive fastener 224 in a direction away from the spring-loaded receptacle to facilitate secure engagement between the stud 266 and the electrically conductive surface 230. In the exemplary embodiment of FIGS. 6 and 7, the electrically conductive fastener 224 is a quarter-turn flat head fastener, wherein the electrically conductive fastener 224 is rotated approximately 90° to engage the stud 266 with the electrically conductive surface 230. Alternatively the electrically conductive fastener 224 is configured to rotate a different angular amount to engage the stud 266 with the electrically conductive surface 230, such as, but not limited to, approximately 180° (sometimes referred to as a half-turn flat head fastener).

Figure 8:
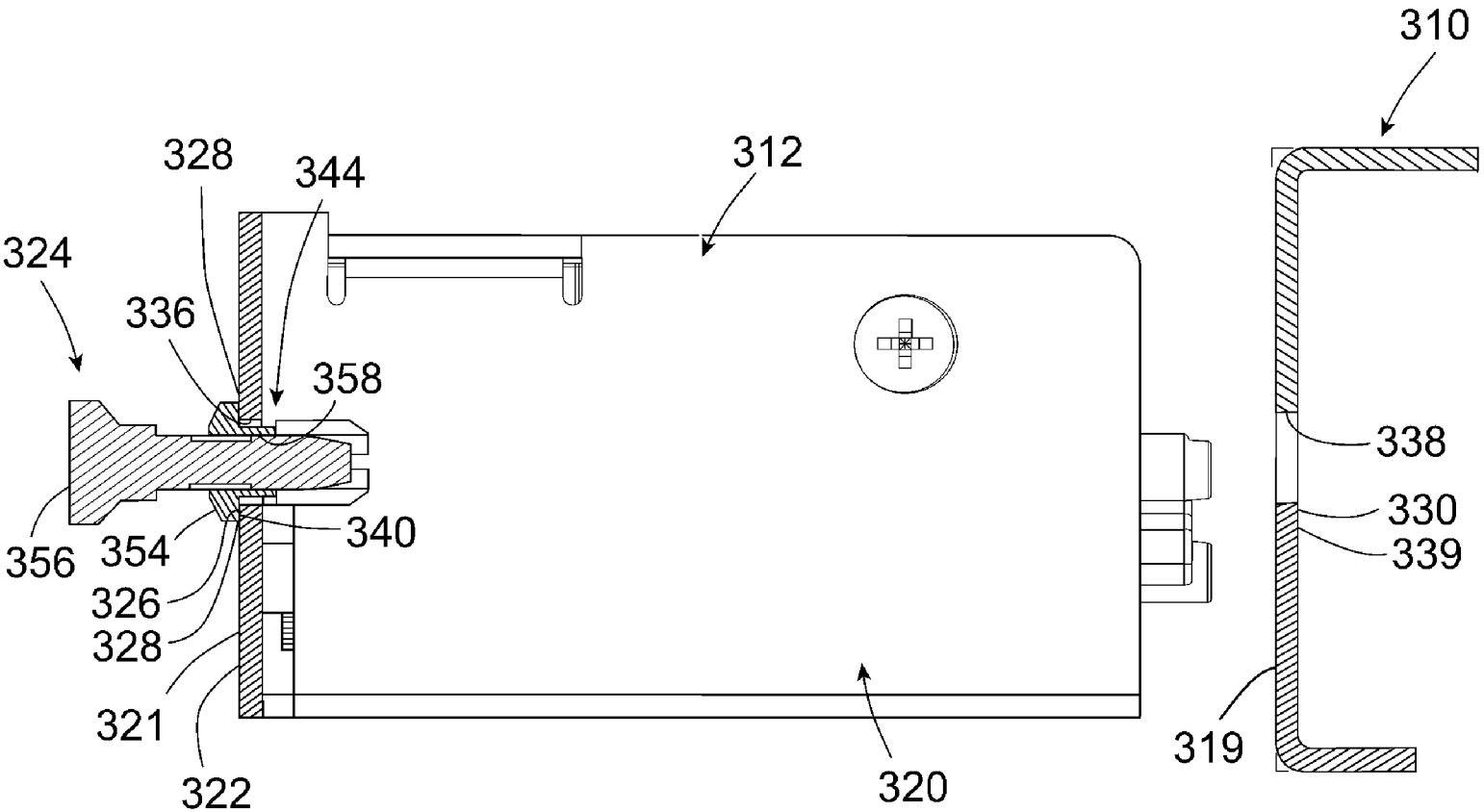
FIG. 8 is an exploded cross-sectional view of an alternative exemplary embodiment of a panel and an alternative exemplary embodiment of an interface module.
Figure 9:
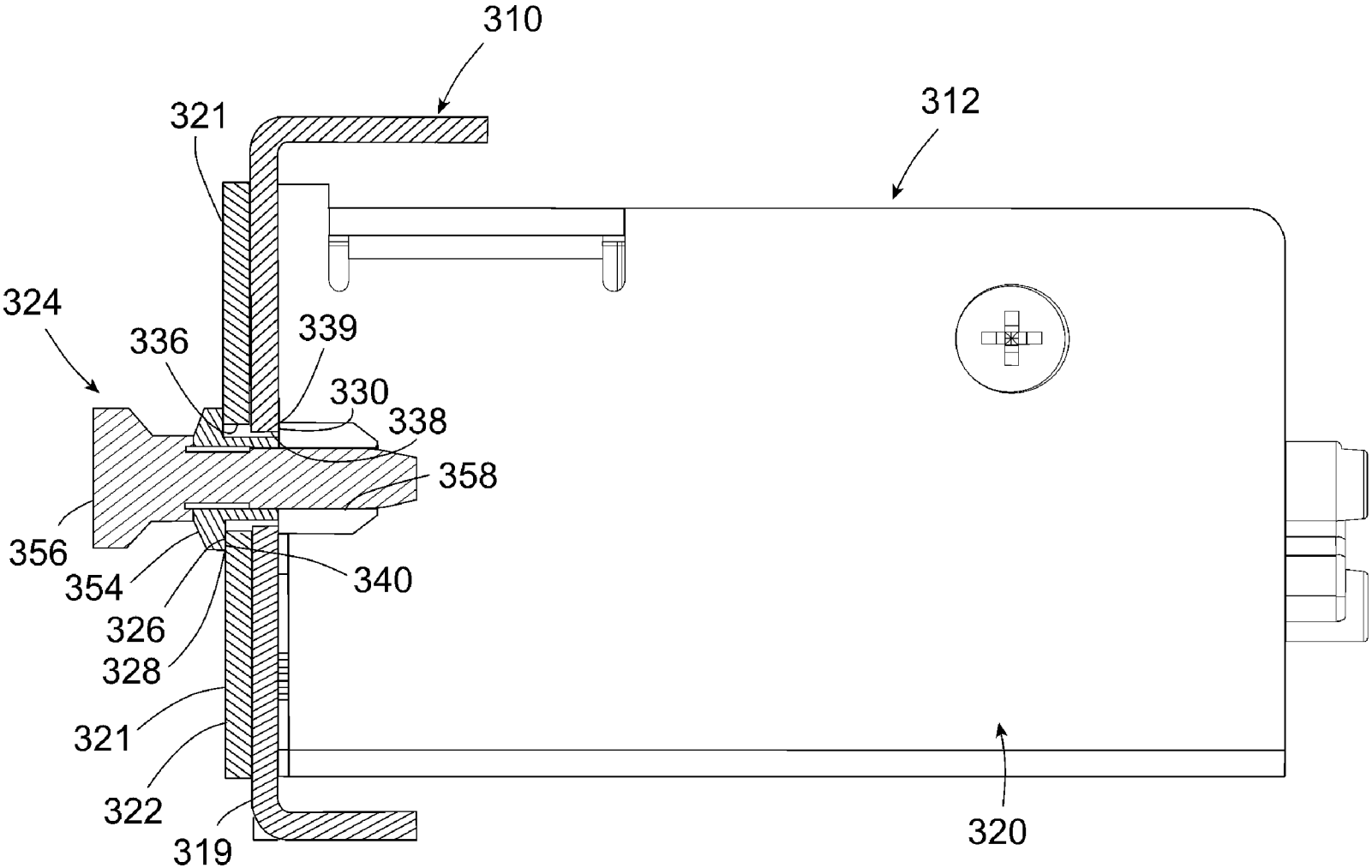
FIG. 9 is a cross sectional view of the interface module and the panel shown in FIG. 8 illustrating the interface module mounted on the panel.

FIG. 8 is an exploded cross-sectional view of an alternative exemplary embodiment of a panel 310 and an alternative exemplary embodiment of an interface module 312. FIG. 9 is a cross sectional view of the interface module 312 and the panel 310 illustrating the interface module 312 mounted on the panel 310. A face plate 322 of a housing 320 of the interface module 312 includes an opening 336 extending there through and the panel 310 includes an opening 338 extending there through. The openings 336 and 338 each receive an electrically conductive fastener 324 therein when the interface module 312 is mounted on the panel 310. In the exemplary embodiment of FIGS. 8 and 9, the electrically conductive fastener 324 is a separable rivet. The electrically conductive fastener 324 includes a grommet 354 and a plunger 356 received within an opening 358 within the grommet 354. When the electrically conductive fastener 324 is received within the opening 336, a housing interface 340 of the grommet 354 engages an electrically conductive portion 326 of the housing 320 that is exposed via an opening 328 within a non-electrically conductive coating 321 of the housing 320.

The grommet 354 includes a panel interface 344 that engages an electrically conductive surface 330 of the panel 310 that is exposed through an opening 339 within a non-electrically conductive coating 319 of the panel 310. The plunger 356 is movable within the grommet opening 358 between an unlatched position (FIG. 8) and a latched position (FIG. 9). In the latched position, the grommet 354 is radially expanded such that the grommet 354 engages the electrically conductive surface 330 of the panel 310.

When the interface module 312 is mounted on the panel 310, the plunger 356 of the electrically conductive fastener 324 is in the latched position such that the housing interface 340 is engaged with the electrically conductive portion 326 of the housing 320 and the panel interface 344 is engaged with the electrically conductive surface 330. Accordingly the housing 320 is electrically connected to the panel 310 via the electrically conductive fastener 324.

Figure 11:
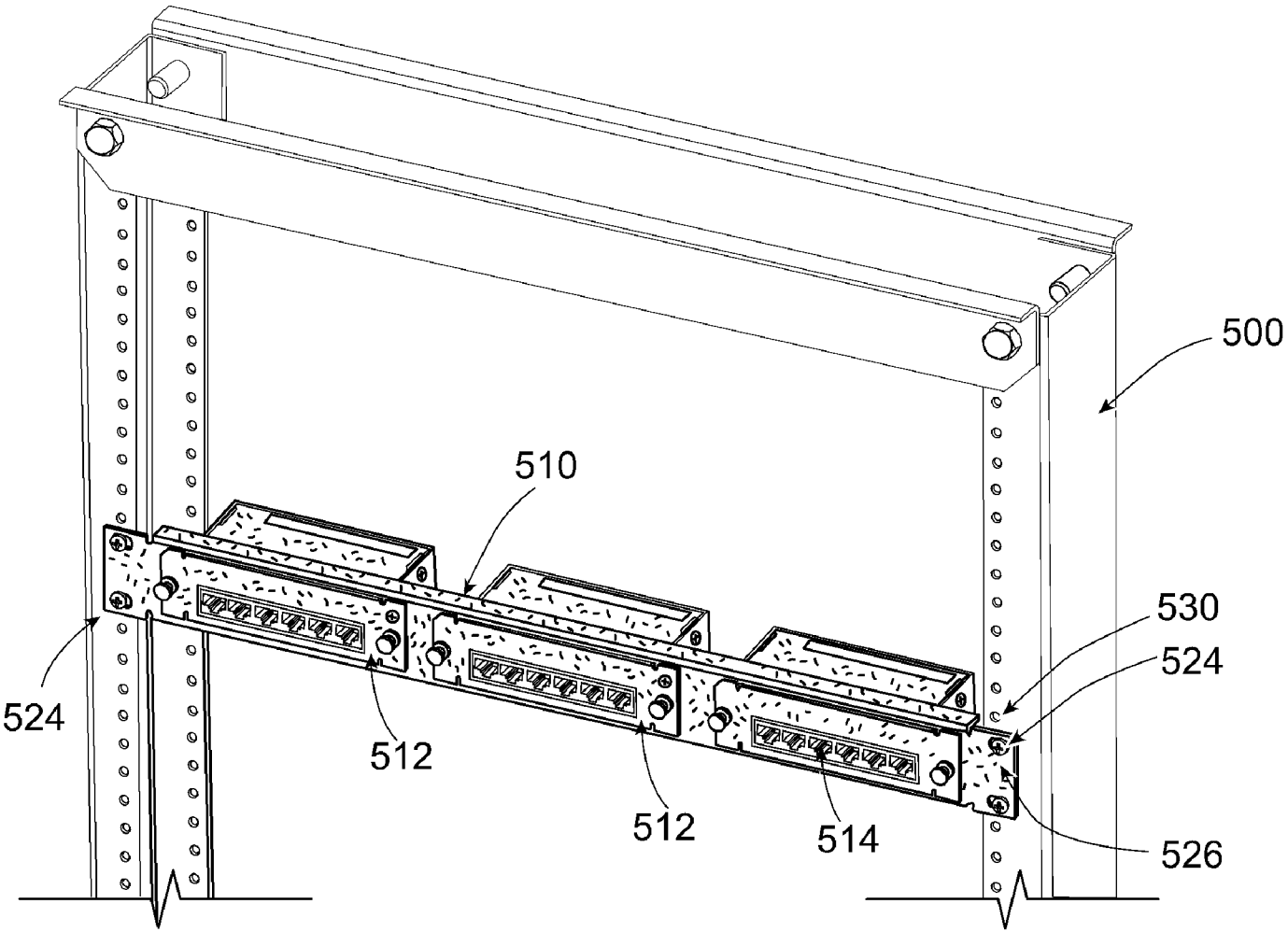
FIG. 11 is a perspective view of an exemplary embodiment of a rack and an exemplary embodiment of a panel mounted on the rack.

FIG. 11 is a perspective view of an exemplary embodiment of rack 500 and an exemplary embodiment of a panel 510 mounted on the rack. In the exemplary embodiment of FIG. 11, the panel 510 holds a plurality of interface modules 512 that each includes a plurality of modular jacks 514. An electrically conductive fastener 524 is provided to facilitate mounting the panel 510 to the rack 500. Specifically the electrically conductive fastener 524 engages an electrically conductive portion 526 of the panel 510 and an electrically conductive surface 530 of the rack 500. The electrically conductive fastener 524 thereby electrically connects the panel 510 to the rack 500. Optionally when one of the components (e.g. the panel 510 and/or the rack 500) is coupled to ground (e.g. electrically grounded), then the electrical connection defines a ground path between the panel 510 and the rack 500. The electrically conductive fastener 524 may also facilitate mechanically coupling the panel 510 to the rack 500.

The electrically conductive fastener 524 may be any suitable type of fastener, and may have any suitable shapes, sizes, and configurations that enable the electrically conductive fastener 524 to electrically connect the panels described and illustrated herein to the racks described and illustrated herein. A non-limiting example of a suitable electrically conductive fastener 524 is shown in FIG. 11. Moreover, the description and illustration of the exemplary electrically conductive fasteners described and illustrated herein for electrically connecting the interface module housings described and illustrated herein to the panels described and illustrated herein is also applicable to the electrically conductive fasteners 524, the panel 510, and the rack 500. Although the panel 510 shown in FIG. 11 includes four electrically conductive fasteners 524, the panel 510 may include any number of electrically conductive fasteners 524.

The embodiments described and illustrated herein provide interface modules that enable a more effective method of completing a bonded and/or grounded path between one or more network components (such as, but not limited to, a cable assembly and/or the like) and a patch panel. The method of bonding and/or grounding is separable to enable the interface modules to be removed from the patch panel.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An interface module comprising:

a housing configured to hold at least one modular jack, the housing being configured to be mounted on a panel, the housing comprising an electrically conductive portion, wherein the housing comprises a non-electrically conductive coating thereon, the electrically conductive portion of the housing being exposed via an opening within the non-electrically conductive coating; and an electrically conductive fastener having a housing interface configured to engage the electrically conductive portion of the housing and a panel interface configured to engage an electrically conductive surface of the panel, the electrically conductive fastener creating an electrical connection between the housing and the panel, wherein the electrically conductive fastener comprises a separable rivet.

2. The interface module of claim 1, wherein the electrically conductive fastener is configured to be received within openings of the housing and the panel.

3. The interface module of claim 1, wherein the housing comprises an opening configured to receive the electrically conductive fastener therein, the opening comprising a recessed surface configured to engage the electrically conductive fastener.

4. The interface module of claim 1, further comprising the panel, the panel comprising a non-electrically conductive coating thereon, the electrically conductive surface of the panel being exposed relative to the non-electrically conductive coating.

5. The interface module of claim 1, wherein the electrically conductive fastener comprises a washer having an extension configured to pierce a non-electrically conductive coating of one of the housing and the panel.

6. An interface module comprising:

a panel having an electrically conductive surface that comprises a threaded portion;

a plurality of modular jacks;

a housing holding the plurality of modular jacks, the housing being configured to be mounted on the panel such that the plurality of modular jacks are mounted on the panel, the housing comprising an electrically conductive portion, wherein the housing comprises a non-electrically conductive coating thereon, the electrically conductive portion of the housing being exposed via an opening within the non-electrically conductive coating; and an electrically conductive fastener having a housing interface configured to engage the electrically conductive portion of the housing and a panel interface configured to engage an electrically conductive surface of the panel, the panel interface comprising a threaded portion that is configured to engage the threaded portion of the panel, the electrically conductive fastener creating an electrical connection between the housing and the panel.

7. The interface module of claim 6 wherein the plurality of modular jacks are shielded and are electrically connected to the housing, the electrically conductive fastener configured to create an electrical connection between the plurality of modular jacks and the panel via the housing.

8. The interface module of claim 6, wherein the electrically conductive fastener comprises a threaded portion that is configured to engage a threaded portion of the panel, the threaded portion of the panel being defined by a nut.

9. The interface module of claim 6, wherein the electrically conductive fastener is configured to be received within openings of the housing and the panel.

10. The interface module of claim 6, wherein the electrically conductive fastener comprises a separable rivet.

11. The interface module of claim 6, wherein the electrically conductive fastener comprises one of a quarter-turn and a half-turn fastener that is configured to be received by a spring-loaded receptacle of the panel.

12. The interface module of claim 6, wherein the electrically conductive fastener comprises a washer having an extension configured to pierce a non-electrically conductive coating of one of the housing and the panel.

13. An interface module comprising:

a housing configured to hold at least one modular jack, the housing being configured to be mounted on a panel, the housing comprising an electrically conductive portion and a faceplate; and an electrically conductive fastener having a housing interface configured to engage the electrically conductive portion of the housing and a panel interface configured to engage an electrically conductive surface of the panel, the electrically conductive fastener creating an electrical connection between the housing and the panel, wherein the electrically conductive fastener comprises a head, the faceplate being held between the panel and the head when the housing is mounted on the panel.

* * * * *